US006481923B1

(12) United States Patent
Casters

(10) Patent No.: US 6,481,923 B1
(45) Date of Patent: Nov. 19, 2002

(54) CONCRETE PAVING MACHINE

(75) Inventor: François Casters, Opglabbeek (BE)

(73) Assignee: Drion Constructie B.V.B.A., Opglabbeek (BE)

( * ) Notice: Subject to any disclaimer, the term of this patent is extended or adjusted under 35 U.S.C. 154(b) by 0 days.

(21) Appl. No.: 09/343,552

(22) Filed: Jun. 30, 1999

(51) Int. Cl.[7] ..... E01C 19/00
(52) U.S. Cl. ..... 404/104; 404/118
(58) Field of Search ..... 404/72, 101, 104, 404/102, 105, 106, 108, 96, 110, 118

(56) References Cited

U.S. PATENT DOCUMENTS 3,693,512 A * 9/1972 Smith ..... 404/101
3,970,405 A 7/1976 Swisher, Jr. et al.
4,074,802 A * 2/1978 Hudis ..... 404/106
4,197,032 A * 4/1980 Miller ..... 404/98
4,789,266 A * 12/1988 Clarke, Jr. et al. ..... 404/96
5,135,333 A * 8/1992 Guntert, Sr. et al. ..... 404/100
5,590,977 A * 1/1997 Guntert et al. ..... 404/101
5,615,972 A * 4/1997 Guntert et al. ..... 404/72
5,879,104 A * 3/1999 Ulrich ..... 404/102

FOREIGN PATENT DOCUMENTS

WO WO 96/37661 11/1996

* cited by examiner

*Primary Examiner*—Thomas B. Will
*Assistant Examiner*—Raymond W Addie
(74) *Attorney, Agent, or Firm*—Bacon & Thomas, PLLC

(57) ABSTRACT

A concrete paving machine (1) for leveling poured concrete (2) is horizontally extendable in both length and width, as well as vertically adjustable for screening concrete masses of varying dimensions. The concrete paving machine is driven on tracks (12) and is further provided with extendable pressure cylinders, which connect a pivotable arm (16) to a fixed support on a side part of the paving machine, in order to position the endless track (12), to stradle the concrete mass being leveled.

17 Claims, 4 Drawing Sheets

Fig. 1
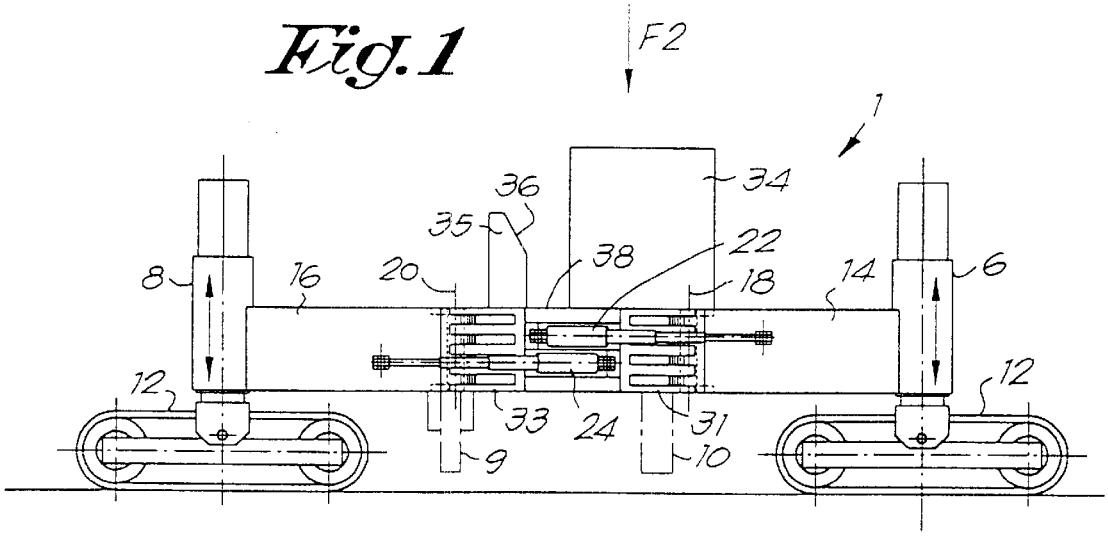
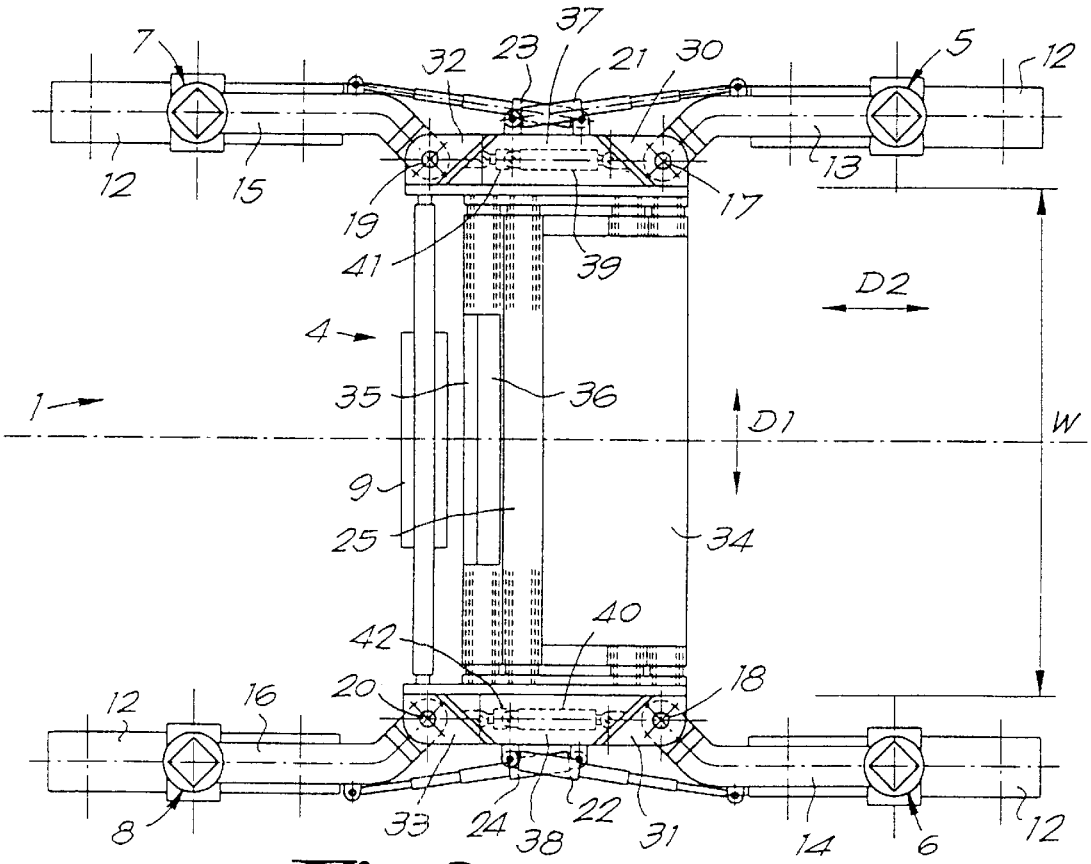
Fig. 2

X
12
12
7
5
15
13
23
21
Y
Y
32
19
17
30
41
39
37
D2
4
1
35
36
D1
L
9
25
34
42
40
38
Y
Y
33
20
18
31
16
14
8
6
12
12
X
A

Fig.6
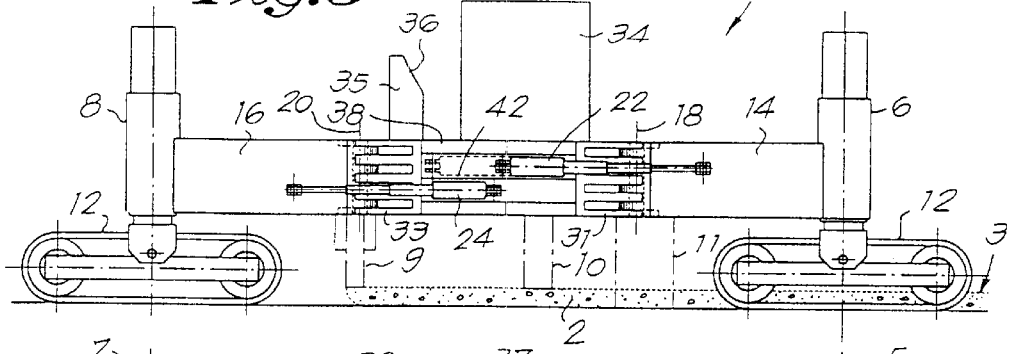
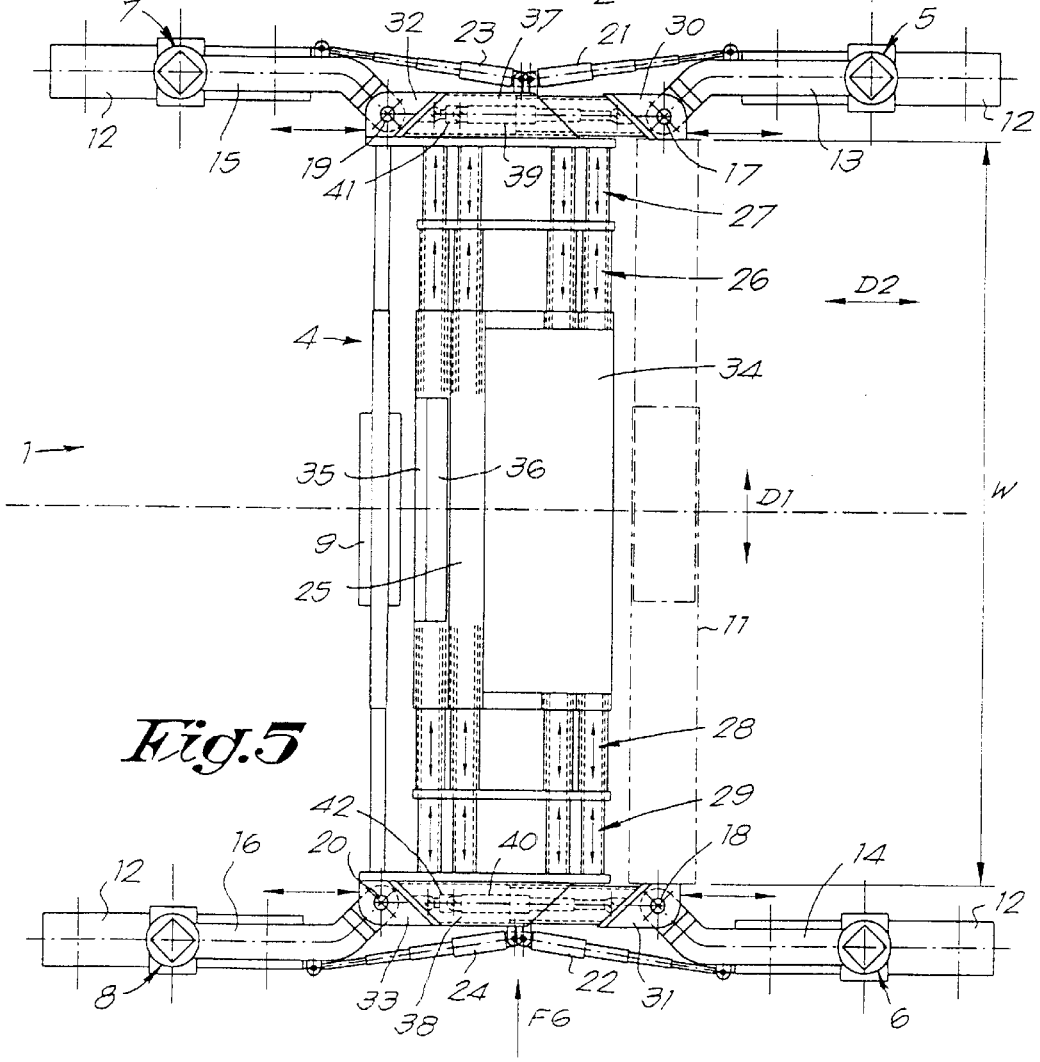
Fig.5

CONCRETE PAVING MACHINE

This invention relates to a concrete paving machine, more particularly a machine for levelling concrete, of the type whereby poured concrete is spread over a predetermined width and this concrete is equalled at a well-defined thickness.

As known, such concrete paving machines are applied for spreading and equalling of concrete, with the intention of forming a floor, plate, road or similar, whereby either or not simultaneously certain profilings can be provided in the formed road, such as a drain, an upstanding edge, a concrete crash barrier, or similar.

It is known that such concrete paving machines generally are composed of a movable frame under which a number of tools is fixed, the aim of which is to distribute the concrete poured in front of the machine, more or less equalling it, vibrating and finally drawing it equal, such that after passing of the concrete paving machine, a completely finished road is created, whereby hereafter one only has to wait for the hardening of the concrete, and eventually provided extension joints will have to be filled.

From the patent documents BE 895.198, BE 1.002.820 and U.S. Pat. No. 3,970,405, it is known to make such concrete paving machines extensible in the direction of a working width, in such a manner that the working width can be adapted to the work to be performed. The extensible embodiments known up to now show the disadvantage that they still are limited in their possibilities and that, in the first place with larger embodiments, for the realization of very wide concrete roads, the transport of such concrete paving machines is very complicated.

From the international patent application WO 96/37661, a concrete paving machine is known the frame of which is extensible perpendicular to the working width, thus, in a direction parallel to the moving direction according to which the concrete paving machine is driven during paving. This known concrete paving machine is provided with support points in the form of track wheels which are attached directly rotatable under the corners of the extensible frame. As a result of such positioning of the track wheels, this concrete paving machine, shows the disadvantage that the track wheels render the accessibility to the tools attached at the frame more difficult. Another disadvantage consists in that unevennesses in the subsoil are directly perceived in the frame, as the track wheels are situated directly under the frame. These unevennesses are perceived even more rapidly in the case that the frame is extended in the aforementioned direction, as this frame, in this extended direction, becomes less rigid and consequently bends more rapidly and every unevenness results in an upward or downward movement at the corner concerned.

The invention aims at a concrete paving machine which is improved.

More particularly, it aims at a concrete paving machine whereby one or both of the aforementioned disadvantages are excluded.

To this aim, the invention relates to a concrete paving machine of the above-mentioned type, with the characteristic that the concrete paving machine is adjustable, extensible respectively, and that it is provided with means as a result of which the adjustment, extension respectively, is optimized. By this optimization is achieved that machines with a large maximum working width still can easily be transported by means of a normal truck and/or that more possibilities in respect to the application of the concrete paving machine are obtained.

In a first preferred form of embodiment, the aforementioned means at least consist of the combination of, on one hand, provisions which allow that the concrete paving machine is adjustable, more particularly, extensible, according to a direction perpendicular to the working width, and, on the other hand, support means in the form of support elements, such as tracks or the like, which are attached on arms extending in respect to the frame and preferably being pivotable in a horizontal plane. Consequently, on one hand, the possibility is obtained to strongly reduce the dimensions of the concrete paving machine in one direction, more particularly, the direction perpendicular to the working width, as a result of which, according to the invention, it becomes possible to transport even very large concrete paving machines on a truck of normal width. On the other hand, the possibility is also created to prolong the concrete paving machine in the direction perpendicular to its working width at random, as a result of which it can easily be provided with additional tools. By combining the extensibility with the use of extending arms, it is obtained that the frame, at its corners, is less sensitive to the unevennesses which are perceived in the support points themselves. As the tracks are attached at extending arms, they form no or little obstruction for the lateral access to tools provided between the frame.

In the case that it can be supposed that the subsoil is even, or in the case that means for automatic height adjustment are provided at the support points, additional tools can be attached between the extending arms.

In a second form of embodiment, the aforementioned means at least consist of provisions which allow that the concrete paving machine is adjustable, more particularly, extensible, at least three times in the direction of its working width, and even better at both sides each time is extensible at least twice, thus, altogether four times. Contrary to the embodiments known up to now, in this manner also the dimension in the direction of the working width can be changed largely, on one hand, with the advantage that a large working range is possible with one and the same machine and, on the other hand, also with the advantage that the length of the concrete paving machine in the transport condition can be optimally reduced.

In the most preferred form of embodiment, a combination is made of, on one hand, provisions which allow that the concrete paving machine is adjustable, more particularly, extensible, in a direction perpendicular to the working width and, on the other hand, provisions which allow that the concrete paving machine is adjustable, more particularly, extensible, in the direction of its working width, in this latter direction preferably at least three times and even better two times at each side.

Preferably, the concrete paving machine will also be extensible in a multiple manner in the direction perpendicular to the working width. More particularly, it is preferred that the lateral flanks of the frame according to the working direction can be extended forward as well as backward. Even more particularly, it shall be possible to extend the frame each time forward as well as backward in a multiple manner.

As usual, the concrete paving machine preferably has a frame at which one or more tools are attached or can be attached, and support means which allow to move this frame. It is noted that the adjustability, extensibility respectively, refers to the actual frame of the concrete paving machine, regardless of which other adjustment means are further provided for positioning the support means at different places. According to the invention, the frame then is composed of different parts which are adjustable, more particularly extensible, in respect to each other, either exclusively in the direction of the working width, or exclusively in a direction perpendicular to the working width, or in both directions.

In a preferred form of embodiment, also one or more of the tools shall be made extensible, either exclusively in the direction of the working width, or exclusively in a direction perpendicular to the working width, or in both directions. As a result, the tools automatically adapt to the working width and/or do not form any obstacle when the concrete paving machine is slid together.

With the aforementioned characteristic that the tools are extensible in both directions, and, thus, also can be slid together, it is meant that the concrete paving machine can be provided with, on one hand, tools which are extensible according to the working width and, on the other hand, tools which are extensible perpendicular to the working width, thus, in the working direction, as well as that the concrete paving machine is provided with one or more tools whereby one and the same tool can perform the two extension movements.

Preferably, the extensible tools are coupled to the extensible parts of the frame, in such a manner that the tools automatically follow the extension movement of the frame.

The concrete paving machine may also be provided with one or more tools which can be detached, which in themselves may either be extensible or not, for example, to be adapted to the working width in mounted condition, in such a manner that the frame, in the detached condition of this tools, can be slid together optimally.

Furthermore, the concrete paving machine according to the invention preferably is provided with support means which consist of support elements which are situated, respectively, in the proximity of the corners of the concrete paving machine, and these support elements are connected to the outermost extensible parts, in such a manner that during extending, sliding together, respectively, of the aforementioned frame the distance between the support elements is also increased, reduced respectively, either exclusively in the direction of the working width, or exclusively in the direction perpendicular to the working width, or in both directions. Hereby, the aforementioned support elements always remain present at the corners of the concrete paving machine, regardless whether this latter is extended or not, as a result of which an optimum stability is guaranteed.

According to the invention, the concrete paving machine preferably has a working width which can be varied between a minimum distance which is smaller than 7 meters and a maximum distance which is larger than 15 meters.

According to a particular characteristic of the invention, the concrete paving machine can be slid together, folded together, respectively, according to the direction perpendicular to its working width, up to a dimension which is smaller than 4 meters, and even better is approximately 3 meters.

With the intention of better showing the characteristics according to the invention, hereafter, as an example without any limitative character, a preferred form of embodiment is described, with reference to the accompanying drawings, wherein:

FIG. 1 in a side elevational view represents a concrete paving machine according to the invention, in working position;

FIG. 2 represents a view according to arrow F2 in FIG. 1;

FIGS. 4 and 5 represent views analogous to that from FIG. 2, in two other working positions;

FIG. 6 represents a view according to arrow F6 in FIG. 5.

Figure 3:
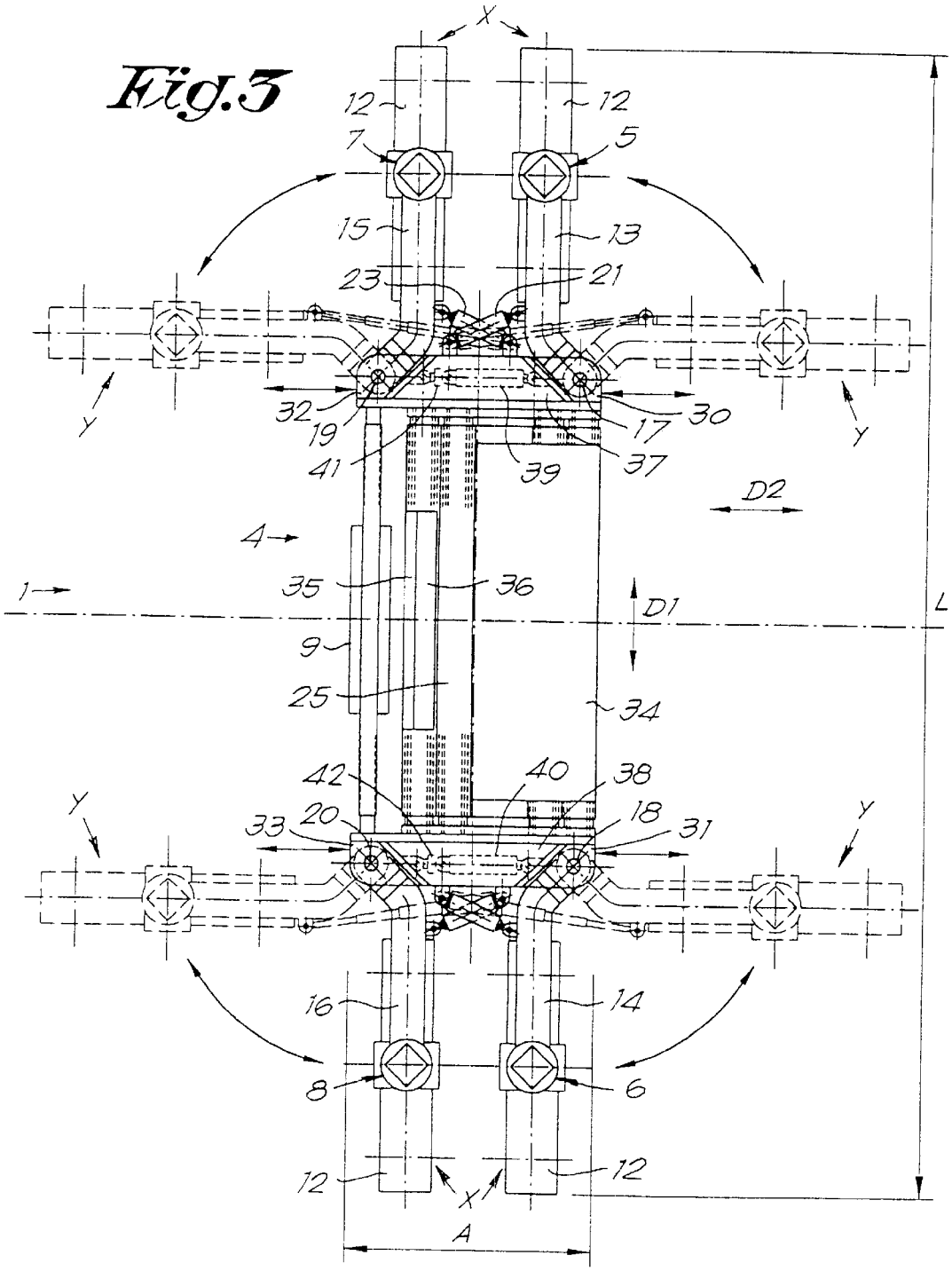
FIG. 3 represents a view analogous to that from FIG. 2, for the transport condition.

As represented in the figures, the invention relates to a concrete paving machine 1 for levelling concrete 2, of the type whereby poured concrete 2 is spread over a predetermined width and this concrete 2, in order to form a road 3 or similar, is equalled at a well-defined thickness or in a well-defined shape.

Substantially, this concrete paving machine 1 consists of a frame 4 and support means which allow to move and/or to roll away this frame 4 which, in this case, consist of four support elements, 5-6-7-8 respectively.

At the frame 4, and possibly also at the support means 5-6-7-8, different tools, in this case three tools, 9-10-11 respectively, are attached for spreading the concrete 2 and bringing it into the shape of a road 3. These tools 9-10-11 can be of different kind and are known in themselves. In the represented example, the tool 9 consists of. a device for distributing the concrete 2, the tool 10 of a device for vibrating the concrete 2, and the tool 11 of a device for equalling the concrete 2 in a well-defined shape. For clearness' sake, these tools 9-10-11 are depicted in a very schematic manner only.

The aforementioned support elements 5-6-7-8 allow for the movability of the frame 4. To this aim, they are provided with tracks 12 or similar which are driven, for example, by means of motors not represented in the figures, more particularly hydraulic motors which are provided at the height of each support element 5-6-7-8.

The support elements 5-6-7-8 are pivotable around the corners of the concrete paving machine 1 in that they are fixed at pivotable arms 13-14-15-16. Hereby, they are, as represented in FIG. 3, movable between a transport position and a working position.

The pivotable arms are rotatable around axes 17-18-19-20 and can be displaced by means of pressure cylinders 21-22-23-24. In one embodiment, the pressure cylinders 21-22-23-24 serve as retaining devices to maintain the pivotable arms in a fixed position when side parts 30-31-32-33 of the flanks 37-38 are extended. It should be noted that other retaining devices can be used to maintain the pivotable arms in a fixed position.

It is noted that the pivotable arms 13-14-15-16, as represented, are made such that the support elements 5-6-7-8, in the transport position, are situated within the minimum distance A to the frame 4. In the working position, the support elements, so to speak, are swung out.

According to the invention, the concrete paving machine 1 is provided with means by which extending is optimized, which, according to the represented preferred form of embodiment, consist in the combination of provisions which allow that the concrete paving machine 1 is extensible in the direction D1 of its working width W, with provisions which allow that said concrete paving machine 1 at the same time is extensible according to the direction D2 perpendicular to the working width W.

To this aim, the frame 4 is composed of a central frame portion comprising various parts 25-26-27-28-29-30-31-32-33 which, as described hereafter, are mutually extensible.

The part 25 forms a base part on which, in this case, a machine housing 34 with a diesel engine for driving a hydraulic unit or the like, together with a console 35 with an operation panel 36.

The telescoping parts 25 to 29 allow for the extensibility of the concrete paving machine 1 in the direction D1, as a result of which the working width W can be adjusted. These telescoping parts 25 to 29 allow for the concrete paving machine 1 to be extended on both sides each time twice. Hereby, the part 26 can be shifted in the base part 25 and the telescoping part 27 in the telescoping part 26. In an analogous manner, the telescoping part 28 can be shifted in the base part 25 and the telescoping part 29 in the telescoping part 28.

Extending, sliding together, respectively, the telescoping parts 26-27 and 28-29 in respect to the base part 25 can take place by means of drive means, such as pressure cylinders or similar, not represented in the figures. It is, however, obvious that other drive means instead of pressure cylinders can be applied, too, such as cables and similar onto which, in the one or the other direction, a tractile force is exerted by means of, for example, a winder driven by means of a motor.

According to another possibility, no special drive means are provided, but extending, sliding in, respectively, is obtained by moving the support elements 5 and 7, on one hand, and 6 and 8, on the other hand, in the position of FIG. 3 away from each other, towards each other, respectively.

The side parts 30-31-32-33 are housed with lateral flanks 37-38.

The side parts 30-31-32-33 of the flanks 37-38 allow for the extensibility of the concrete paving machine 1 in the aforementioned direction D2. To this aim, these parts are attached extensible at the lateral flanks 37-38. Extending, sliding in, respectively, is performed by means of drive means which, in the represented example, consist of pressure cylinders 39-40-41-42.

As schematically represented, also the tools 9-10-11 are made extensible, at least in the direction D1. It is obvious that according to the invention also tools could be provided which are extensible in the direction D2.

As can be deduced from the FIGS. 3 and 5 respectively, the tool 11 can be dismounted, as a result of which the frame 4, in the dismounted condition of this tool, can be slid together in an optimum manner.

It is noted that, as represented in the figures, the support elements 5-6-7-8 preferably are attached at the corners of the concrete paving machine 1, more particularly, at the outermost extensible parts 30-31-32-33.

Working and use of the concrete paving machine 1 can easily be deduced from the figures.

In the transport condition which is shown in FIG. 3, the concrete paving machien 1 has ideal dimensions for being placed upon a motor lorry. Due to the fact that the machine hereby is slid together in a multiple manner according to the direction D1, the total transport length L can be limited to a minimum. Due to the fact that the concrete paving machine 1 can also be slid together according to the direction D2, and certain tools, in this case, the tool 11, can at the same time be dismounted, also the total transport width A can be kept very small, even if a concrete paving machine 1 is concerned which, in extended condition, takes up a relatively large surface.

When taking the concrete paving machine 1 into use, the support elements 5-6-7-8 are swung out up to a position as represented in the FIGS. 1 and 2.

Figure 4:
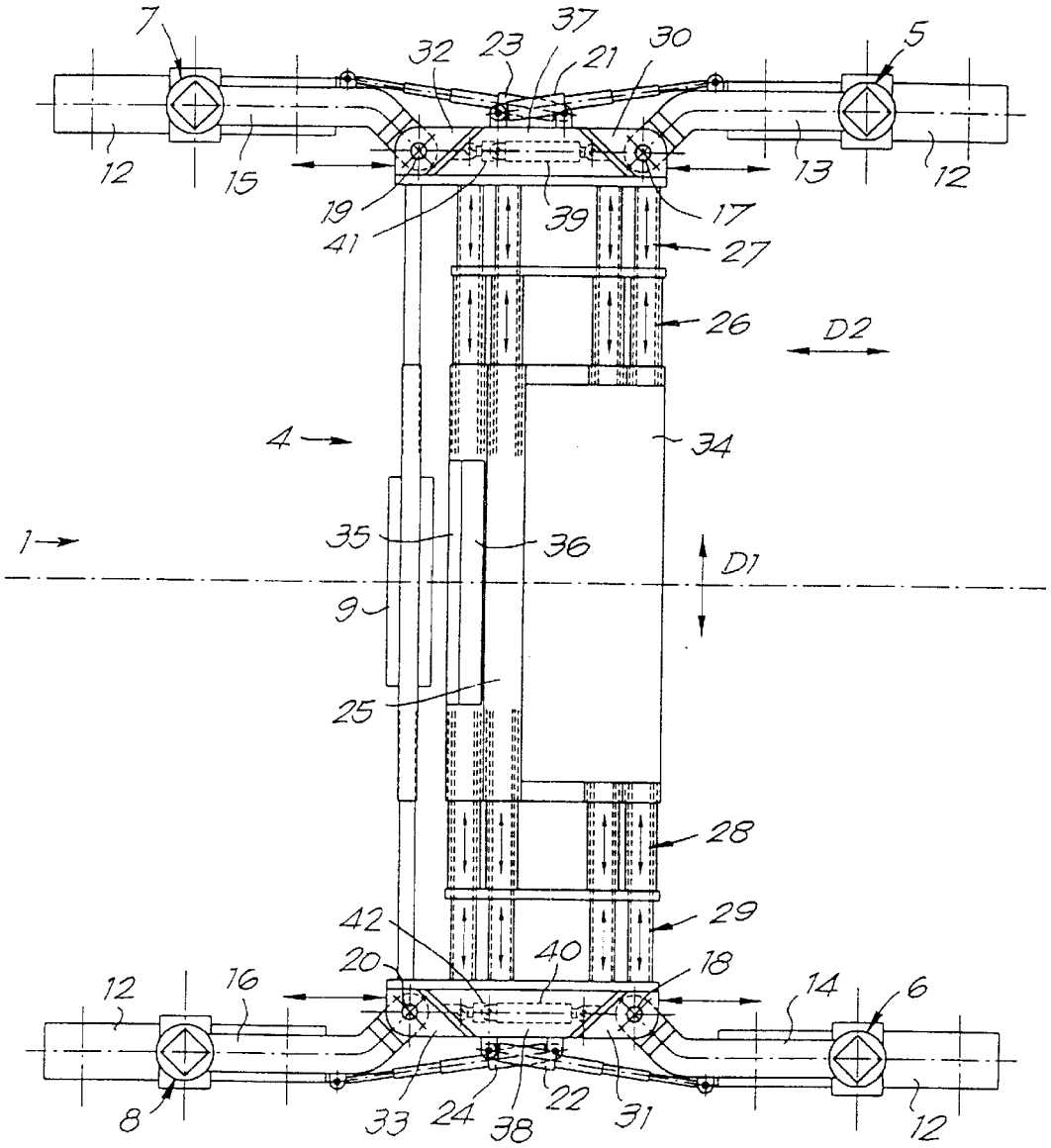

As a result of the extension of one or more of the parts 26-27-28-29, the working width W can be adapted to the work to be performed, which becomes clear from the FIGS. 4, 5 and 6.

By extending the frame 4 according to the direction D2, additional possibilities in respect to the use of tool are created, as thereby more space becomes free for the attachment of tools and/or the mutual space between the tools becomes larger.

In FIG. 5, only the parts 30 and 31 are extended. It is, however, obvious that the parts 32 and 33 can be extended in an analogous manner. In a variant not represented, the parts 30-31-32-33 each shall be extensible in a multiple manner, for example, telescopically.

By extending the frame even further in the direction D2, additional devices can be mounted at the frame, such as a dowel apparatus for vibrating reinforcing bars or anchoring bars into the concrete. It is also possible to attach further devices behind the concrete paving machine, such as, for example, a smoothening device.

According to the invention, the expression "extensible" has to be interpreted in a broad manner. By extensible, slidable together, respectively, it is intended that the parts concerned can move in respect to each other in such a manner that an enlargement, reduction, respectively, of the total dimension is obtained. Hereby, the parts concerned may be slidable telescopically in each other, as well as slidable sideways alongside each other. Hereby, the parts concerned may be supported in a sliding manner as well as in a rolling manner in respect to each other.

Although the extensible embodiment is the most advantageous, it is, according to the invention, not excluded to apply other adjustable means in order to allow the adjustments according to the directions D1 and D2.

The present invention is in no way limited to the forms of embodiment described by way of example and represented in the figures, on the contrary may such concrete paving machine be realized in various forms and dimensions, without leaving the scope of the invention.

What is claimed is:

1. A concrete paving machine for leveling concrete along a paving path having a width W, said concrete paving machine comprising:

a frame having opposed first and second lateral flanks, said opposed lateral flanks each including at least two side parts extensible relative to each other along a direction D2 perpendicular to the width W;

support elements supporting said concrete paving machine, each of said support elements being carried by a pivotable arm pivotally connected to one of said side parts; and extendable pressure cylinders each extending between and pivotably connected to one of said pivotable arms and said side part connecting to said respective pivotable arm, said pressure cylinders arranged to position and maintain said pivotable arms in a predetermined position with respect to said lateral flanks.

2. The concrete paving machine according to claim 1 wherein the support elements comprise crawler tracks.

3. The concrete paving machine according to claim 1 wherein said frame is extensible along a direction D1 perpendicular to said direction D2.

4. The concrete paving machine according to claim 1 further comprising at least one tool supported by said frame, said at least one tool arranged so as to move with said frame at least when said frame extends in one of the directions D1 to D2.

5. The concrete paving machine according to claim 4 wherein said at least one tool is extensible along the direction D1.

6. The concrete paving machine according to claim 4 wherein said at least one tool is extensible along the direction D2.

7. The concrete paving machine according to claim 1 further comprising a central frame portion generally positioned parallel along a direction D1 perpendicular to said direction D2, said central frame portion connecting to each of said lateral flanks.

8. The concrete paving machine according to claim 7 wherein said side parts are extensible along a forward direction and a reverse direction parallel to the direction D2.

9. The concrete paving machine according to claim 7 wherein said a central frame portion comprises at least three extensible members arranged so that at least one extensible member is interposed by a first extensible member connecting at one end to one of said lateral flanks and a second extensible member connecting at one end to another of said lateral flanks.

10. The concrete paving machine according to claim 1 wherein said support elements are pivotable so that said concrete paving machine is adapted for rolling movement along the direction D1.

11. The concrete paving machine according to claim 1 wherein said concrete paving machine is extensible in the direction of the width W between a minimum distance that is less than 7 meters and a maximum distance that is greater than 15 meters.

12. The concrete paving machine according to claim 1 wherein said concrete paving machine is retractable along the direction D2 such that the length of said concrete paving machine along the direction D2 is less than 4 meters.

13. The concrete paving machine according to claim 1 wherein said pivotable arms are pivotable between a direction D1 parallel to said width W and the direction D2.

14. The concrete paving machine according to claim 7 wherein said central frame portion comprises at least four extensible members, said frame being at least three times extensible in the direction D1.

15. The concrete paving machine according to claim 7 wherein said central frame portion comprises at least five extensible members, said frame being at least four times extensible in the direction D1.

16. The concrete paving machine of claim 13 wherein said central frame portion includes a central base and extensible members disposed on opposite sides thereof, said extensible members arranged to extend a predetermined distance from a respective side of said central base to a respective one of said lateral flanks.

17. The concrete paving machine of claim 14 wherein said central frame portion includes at least two extensible members positioned on each side thereof, at least one extensible member telescoping into the other and structured and arranged to be continuously telescoped when said concrete paving machine is in operation, said extensible members further being arranged to telescope into said central base.

* * * * *